US010933667B2

(12) United States Patent
Ohara

(10) Patent No.: US 10,933,667 B2
(45) **Date of Patent: *Mar. 2, 2021**

(54) PRINTING METHOD AND PRINTING APPARATUS

(71) Applicant: MIMAKI ENGINEERING CO., LTD., Nagano (JP)

(72) Inventor: Eiichi Ohara, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/590,383

(22) Filed: Oct. 2, 2019

(65) Prior Publication Data

US 2020/0031122 A1 Jan. 30, 2020

Related U.S. Application Data

(62) Division of application No. 15/780,638, filed as application No. PCT/JP2016/086493 on Dec. 8, 2016, now Pat. No. 10,471,712.

(30) Foreign Application Priority Data

Dec. 11, 2015 (JP) ..... JP2015-242713

(51) Int. Cl.

| | |
|---|---|
| ***B41J 19/14*** | (2006.01) |
| ***B41J 11/00*** | (2006.01) |
| ***B41J 2/045*** | (2006.01) |

(52) U.S. Cl.
CPC ..... *B41J 19/142* (2013.01); *B41J 2/04586* (2013.01); *B41J 11/002* (2013.01)

(58) Field of Classification Search
CPC ..... B41J 19/142; B41J 2/04586; B41J 11/002
See application file for complete search history.

(56) References Cited

U.S. PATENT DOCUMENTS

| | | | | |
|---|---|---|---|---|
| 10,471,712 | B2 * | 11/2019 | Ohara | B41J 11/002 |
| 2008/0192101 | A1 * | 8/2008 | Hoshino | B41J 11/002 347/102 |

* cited by examiner

*Primary Examiner* — Sharon Polk
(74) *Attorney, Agent, or Firm* — JCIPRNET

(57) ABSTRACT

A printing method and a printing apparatus are provided. After ink droplets of a photocurable ink are landed on a print medium, a scan of applying a light to cure the ink droplets to form dots is performed alternately in a forward direction and a backward direction with respect to a predetermined unit region, and a time from landing to curing of the ink droplets onto the print medium differs between the forward direction and the backward direction. The printing method includes: providing the ink droplets that include: a large dot having a large amount of ink per droplet, and a small dot having a smaller amount of ink per droplet than that of the large dot; and controlling ejection of the ink droplets, such that number of passes when forming the large dot is greater than number of passes when forming the small dot, when forming a print image.

8 Claims, 9 Drawing Sheets

GLOSS PORTION

MATTE PORTION

GLOSS PORTION

MATTE PORTION

PRINTING METHOD AND PRINTING APPARATUS

CROSS-REFERENCE TO RELATED APPLICATIONS

This application is a divisional application of U.S. application Ser. No. 15/780,638, filed on Jun. 1, 2018, now allowed, which is a 371 application of the international PCT application serial no. PCT/JP2016/086493, filed on Dec. 8, 2016, which claims the priority benefits of Japan application no. 2015-242713, filed on Dec. 11, 2015. The entirety of each of the above-mentioned patent applications is hereby incorporated by reference herein and made a part of this specification.

TECHNICAL FIELD

The present invention relates to a printing method and a printing apparatus by a multi-pass method in which printing is performed by a plurality of passes.

BACKGROUND ART

In a printing apparatus using a photocurable ink that is cured when irradiated with light such as ultraviolet rays, a carriage provided with heads performs scans, and, in a single scan, ejection of ink droplets and light radiation for curing the ink droplets landed on a recording medium are performed. Patent Literature 1 describes control of light radiation to eliminate variations of glossiness caused by dots formed so as to protrude on a recording medium when the landed ink droplets are cured by light radiation.

CITATION LIST

Patent Literature

Patent Literature 1: Japanese Unexamined Patent Application Publication No. 2005-199563

SUMMARY

Technical Problem

In such a printing apparatus, when the carriage reciprocates to perform scans in units of passes, the time from ejection of ink droplets to curing by light differs between a forward scan and a backward scan, depending on the distance between the head and the light source in the carriage. As for the head disposed at a position that is close to the light source in the forward scan direction and is far from the light source in the backward scan direction, in the forward scan, light is applied relatively early after ejection of ink droplets, whereas in the backward scan, light is applied later than in the forward scan after the ejection of ink droplets.

Adjacent ink droplets on a recording medium merged together after landing, if the distance therebetween is small, and soon become completely integrated. Therefore, if the time from landing of ink droplets to curing by light radiation varies, the degree of merging of ink droplets varies, and the shape of dots formed by curing varies accordingly. If ink droplets are cured early after landing, the degree of merging of adjacent ink droplets is low, and the dots formed by curing have protrusions and depressions formed with the merged portions between ink droplets and the apexes of the ink droplets. On the other hand, as curing of ink droplets is late, the degree of merging of adjacent ink droplets is higher, and the dots formed by curing become almost flat, because the difference in height between the merged portion of ink droplets and the apex of each ink droplet disappears.

The degree of protrusions and depressions in the surface thus differs between the portion of the forward scan and the portion of the backward scan in a print image, because of the time difference as described above. Thus, the finished print image has streaks called fringes, which are alternate stripes in which portions that look different colors alternately appear in units of passes because light reflects differently depending on the angle of view. The aforementioned streaks lead to degradation of print quality.

The present invention is made in view of the problem above and is aimed to improve print equality of a printing apparatus by a multi-pass method.

Solutions to the Problems

In order to solve the problem above, the present invention provides a printing method, wherein after ink droplets of a photocurable ink are landed on a print medium, a scan of applying a light to cure the ink droplets to form dots is performed alternately in a forward direction and a backward direction with respect to an unit region which is predetermined. The time from landing to curing of the ink droplets onto the print medium differs between the forward direction and the backward direction. The printing method includes: providing the ink droplets that include: a large dot having a large amount of ink per droplet, and a small dot having a smaller amount of ink per droplet than that of the large dot; and controlling ejection of the ink droplets, such that number of passes when forming the large dot is greater than number of passes when forming the small dot, when forming a print image.

In order to solve the problem above, the present invention provides a printing apparatus including: a head, including a plurality of nozzles for ejecting ink droplets of photocurable ink to a print medium, the nozzles being arranged in a sub scanning direction orthogonal to a main scanning direction to form a nozzle row; a movement controller, configured to move the head in the main scanning direction, so as to perform a scan in the main scanning direction back and forth multiple times on an unit region which is predetermined and to move the head relative to the print medium in the sub scanning direction for each scan in the main scanning direction; light sources, configured to apply a light to the ink droplets to cure the ink droplets ejected to the print medium to form dots, the light sources being disposed on both sides in the main scanning direction of the head; and an ejection controller, configured to control ejection of the ink droplets such that, the ink droplets include: a large dot having a large amount of ink per droplet, and a small dot having a smaller amount of ink per droplet than that of the large dot, and in the scan performed multiple times, a subsequent scan of forming a surface layer of the unit region is performed by ejecting the small dot on a constant ejection duty.

In the configuration described above, the dots are not in contact with each other in the subsequent scan to finish an image, thereby preventing dots from coming into contact each other to be flat. Irrespective of the state of protrusions and depressions of dots formed in the previous main scan, protrusions and depressions can be formed in the surface layer. Thus, the surface layer of the print image attains a uniform state of protrusions and depressions, so that the surface state is indistinguishable between the portion of the forward scan and the portion of the backward scan in the print image, and therefore fringes can be invisible.

In the printing method, it is preferable that, in the scan performed multiple times, ejection of the ink droplets is controlled such that a subsequent scan of forming a surface layer of the unit region is performed by using the small dot, and a preceding scan that is a scan performed before the subsequent scan is performed by using the large dot.

In the configuration described above, whether the dots are in contact with each other can be controlled by adjusting the amount of ink droplets. Thus, fringes can be reduced without affecting the image quality, irrespective of the level of density of color.

In the printing method, it is preferable that, for at least part of the dots formed in the preceding scan in the scan performed multiple times, ejection of the ink droplets be controlled such that an amount of the ink droplets ejected to form one of the dots is equal to an amount of the ink droplets ejected to form one of the dots formed in the subsequent scan.

In the configuration described above, the dots in the preceding scan include dots formed with an amount equal to the ejection amount of ink droplets in the subsequent scan and dots formed with an amount larger than the ejection amount of ink droplets in the subsequent scan. Thus, variable dots having different sizes can be formed also in the preceding scan serving to suppress fringes in the surface of the print image and to form an image. The image quality thus can be improved.

In the printing method, it is preferable that, in the subsequent scan, ejection of the ink droplets be controlled based on a constant ejection duty.

In the configuration described above, the ejection duty is kept constant in the subsequent scan, so that dots are formed uniformly over the entire surface layer by the subsequent scan for finishing an image. Thus, fringes can be suppressed effectively without causing unevenness in the scan region.

In the printing method, it is preferable that, in an intermediate scan performed before the subsequent scan, ejection of the ink droplets be controlled such that the dots are formed at a density so that the dots in an intermediate layer formed by the intermediate scan are not in contact with each other, and ejection of the ink droplets be controlled based on a constant ejection duty.

In the configuration described above, even when the ejection duty is not constant in the subsequent scan, dots are formed uniformly in a scan region in the preceding stage, so that fringes can be suppressed more effectively. When the ejection duty is kept constant in the subsequent scan, unevenness can be suppressed in the scan region more effectively, thereby suppressing fringes effectively.

In the printing method, it is preferable that, in a preceding scan performed before the subsequent scan in the scan performed multiple times, ejection of the ink droplets be controlled such that the dots are formed at a density so that at least part of the dots ejected to a surface of the print medium are merged together.

When a high-density image is formed, if ink droplets are ejected such that the dots are not in contact with each other in all of the multiple scans, an enormous number of scans are required for printing. The number of scans thus need to be increased, and the printing speed is significantly reduced. By contrast, in the configuration described above, in a high-density image, at least part of dots are in contact with each other in a preceding scan. This enables formation of an image with a smaller number of scans. Thus, reduction of the printing speed can be suppressed.

In the printing apparatus, it is preferable that the ejection controller make a setting such that: a smallest ejection amount of the ink droplets is ejected by the nozzles in a range which is predetermined forward of an end portion on a back side of the head when the head moves relative to the print medium in the sub scanning direction, and the range includes a subsequent scan range to eject the ink droplets in the subsequent scan, and the ejection controller make a setting such that: a largest ejection amount of the ink droplets is ejected by the nozzles in a range on a front side of the head relative to the subsequent scan range.

Thus, dots having different sizes can be formed in the front and the back in the relative movement direction of the head. Accordingly, dots of desired sizes can be formed in the scan order formed by the multi-pass.

Effect of the Invention

The present invention achieves the advantageous effect of improving print quality of a printing apparatus by a multi-pass method.

DESCRIPTION OF EMBODIMENT

An embodiment of the present invention will be described below with reference to FIG. 1 to FIG. 15.

[Configuration of Printing Apparatus 1]

Figure 1:
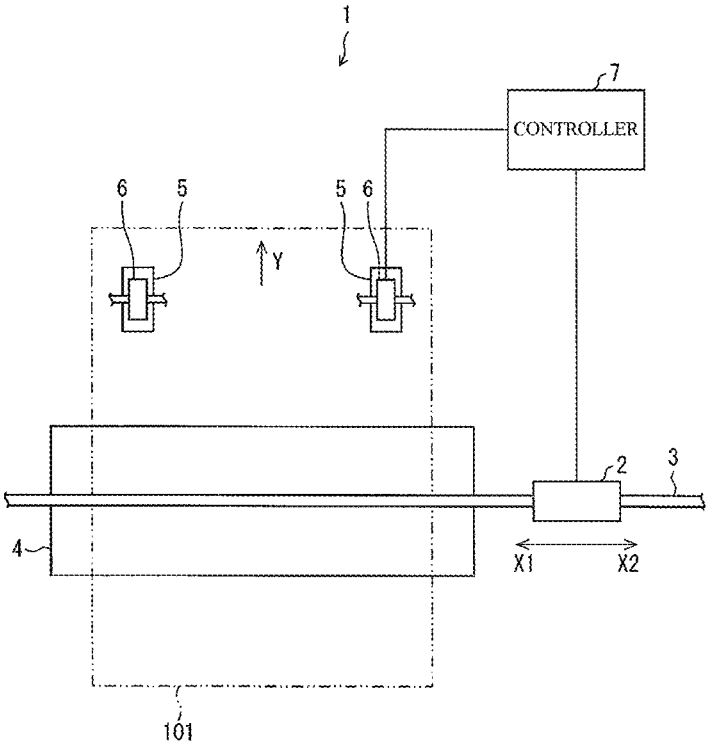
FIG. 1 is a plan view illustrating a configuration of the main part of a printing apparatus according to an embodiment of the present invention.
Figure 2:
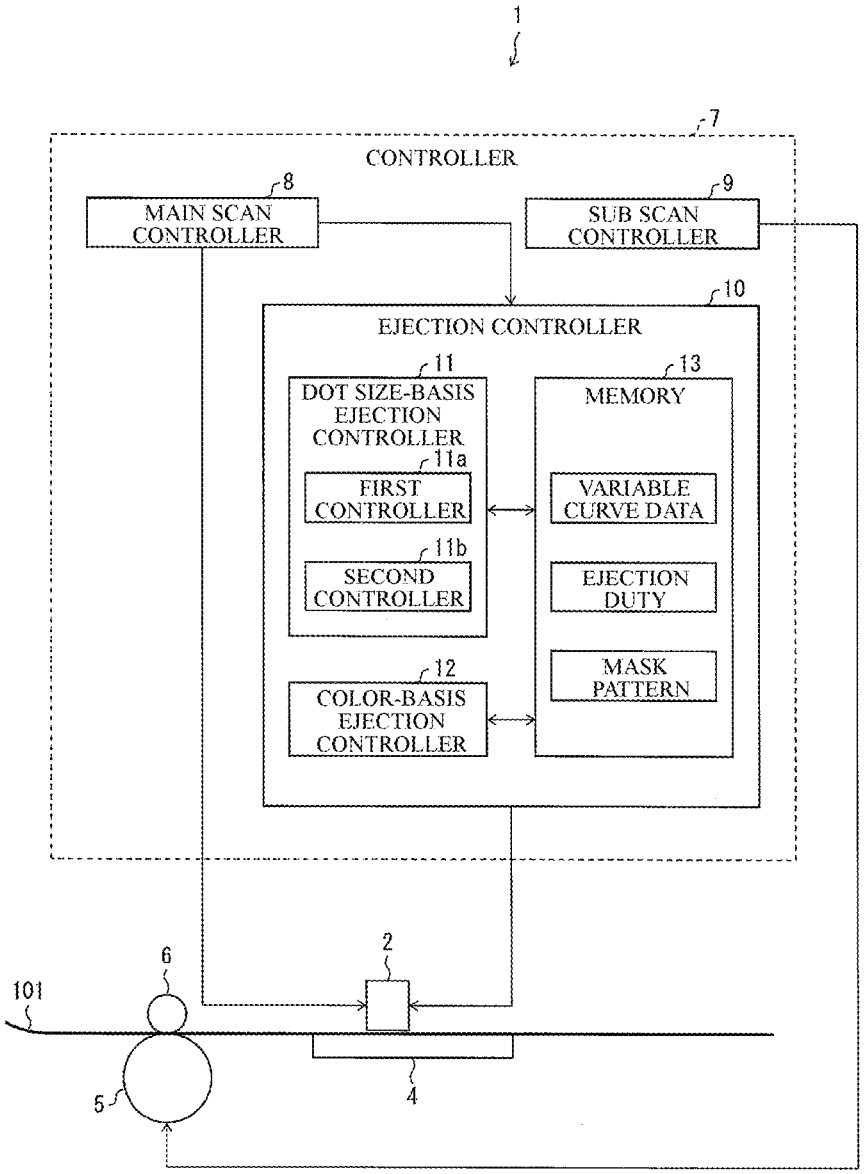
FIG. 2 is a side view illustrating a configuration of the main part of the printing apparatus.
Figure 3:
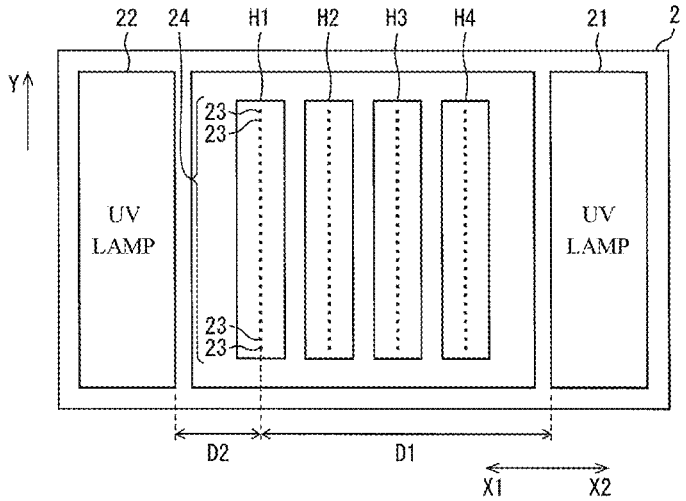
FIG. 3 is a bottom view illustrating a configuration of a carriage in the printing apparatus.

FIG. 1 is a plan view illustrating a configuration of a printing apparatus 1, and FIG. 2 is a side view illustrating a configuration of the printing apparatus 1. FIG. 3 is a bottom view illustrating a configuration of a carriage 2.

As illustrated in FIG. 1 and FIG. 2, the printing apparatus 1 includes a carriage 2, a guide rail 3, a platen 4, driving rollers 5, driven rollers 6, and a controller 7. The printing apparatus 1 is a printer that performs recording by a multi-pass method. The printing apparatus 1 uses ultra violet (UV) curable ink as a printing ink.

The carriage 2 is supported so as to be able to reciprocate for each pass in a main scanning direction X1 and a direction X2 opposite to X1 along the guide rail 3. As illustrated in FIG. 3, the carriage 2 is provided with heads H1 to H4 and UV lamps 21 and 22. The heads H1 to H4 are disposed at the center of the carriage 2 having a rectangular shape. The UV lamp 21 is disposed on one end side of the carriage 2 that is the front side of the carriage 2 moving in the main scanning direction X2. The UV lamp 22 is disposed on the other end side of the carriage 2 that is the front side of the carriage 2 moving in the main scanning direction X1. The heads H1 to H4 are disposed in the order of the heads H1, H2, H3, and H4 from the side close to the UV lamp 22.

The heads H1 to H4 are printing heads for ejecting ink droplets to a print medium 101. The heads H1 to H4 are provided with a plurality of nozzles that are open on an ink ejection surface and arranged in a plurality of rows along a sub scanning direction Y orthogonal to the main scanning directions X1 and X2. Ink droplets are ejected from these nozzles. The head H1 ejects cyan (C) ink, the head H2 ejects magenta (M) ink, the head H3 ejects yellow (Y) ink, and the head H4 ejects black (K) ink.

Here, the front-side ends of the heads H1 to H4 moving in the sub scanning direction Y relative to the print medium 101 are referred to as the front end portions of the heads H1 to H4, and the back-side ends of the heads H1 to H4 moving similarly are referred to as the back end portions of the heads H1 to H4.

The heads H1 to H4 are each provided with a plurality of nozzles 23 that are open on the ink ejection surface and arranged in a row along the sub scanning direction Y. These nozzles 23 constitute a nozzle row 24. The nozzles 23 are divided into groups corresponding to a plurality of passes. For example, the nozzles are divided into groups corresponding to the first pass to the n-th pass, for the regions divided in order from the front end portions of the heads H1 to H4.

The UV lamps 21 and 22 are light sources that apply ultraviolet rays to the ink droplets (UV curable ink) ejected from the nozzles 23 of the heads H1 to H4 and landed on the print medium 101. The UV lamps 21 and 22 are each configured with an arrangement of a plurality of UV-light emitting diodes (LEDs).

Although ultraviolet curable ink is used as ink in the present embodiment, any other photocurable inks that are cured by light other than ultraviolet rays may be employed.

When the carriage 2 scans, i.e., moves, a forward path in the main scanning direction X1, the ink droplets landed on the print medium 101 are irradiated with ultraviolet rays from the UV lamp 21. When the carriage 2 scans a backward path in the main scanning direction X2, the ink droplets are irradiated with ultraviolet rays from the UV lamp 22.

The platen 4 is a support stage provided at a position opposed to the guide rail 3 on which the carriage 2 moves. The platen 4 has a mechanism for defining the position of the print medium 101 and fixing the print medium 101, for example, by adsorption.

The driving roller 5 is a roller receiving a driving force through a drive shaft to rotate. Two driving rollers 5 are disposed at a predetermined distance from each other in the main scanning directions X1 and X2. The driven roller 6 is a roller in abutment with the driving roller 5 to rotate in a direction opposite to the driving roller 5. Two driven rollers 6 are disposed to be opposed to the driving rollers 5. The driving roller 5 and the driven roller 6 hold the print medium 101 therebetween to convey the print medium 101 in the opposite direction to the sub scanning direction Y at a predetermined pitch, in accordance with rotation of the driving roller 5. The pitch is a width in the sub scanning direction Y of a print region that is a band printed by the heads H1 to H4 in one scan.

In the following description, the main scanning directions X1 and X2 are simply referred to as the main scanning direction X unless the directions are specified.

The controller 7 includes a main scan controller 8, a sub scan controller 9, and an ejection controller 10. The controller 7 controls the on/off of the UV lamps 21 and 22.

The main scan controller 8 serving as a movement controller controls, for example, the operation of a motor for driving the carriage 2 to move the carriage 2 in the main scanning direction X. The main scan controller 8 also outputs a scan start signal before the start of a scan to change the line for each scan and outputs a scan end signal after the end of a scan.

The sub scan controller 9 serving as a movement controller controls, for example, the operation of a motor for driving the driving roller to convey the print medium 101 in a direction opposite to the sub scanning direction Y. The sub scan controller 9 controls the rotation of the motor so as to convey the print medium 101 by the amount of conveyance at the pitch described above every time each scan in the main scanning direction X is finished.

The main scan controller 8 and the sub scan controller 9 perform control to move the heads H1 to H4 in the main scanning direction X so as to perform a scan multiple times in the main scanning direction X while ejecting ink droplets to a pass that is a predetermined unit region and to move at least the heads H1 to H4 or the print medium 101 in the sub scanning direction Y such that the heads H1 to H4 and the print medium 101 move relative to each other for each scan in the main scanning direction X. Printable regions are thus printed step by step.

The ejection controller 10 is a controller that controls ejection of ink droplets from the heads H1 to H4 and includes a dot size-basis ejection controller 11, a color-basis ejection controller 12, and a memory 13.

The dot size-basis ejection controller 11 controls ejection of ink droplets such that the pass that is the timing of ejecting ink droplets and the amount of ink droplets vary according to the size of dots formed by ink droplets landed on the print medium 101. The dot size-basis ejection controller 11 includes a first controller 11*a* and a second controller 11*b*.

The first controller 11*a* and the second controller 11*b* are controllers that control ejection of ink droplets by setting the number of passes for L dots, M dots, and S dots individually. On the other hand, the second controller 11*b* controls ejection of ink droplets so as to form S dots after forming L dots and M dots.

Here, L dots, M dots, and S dots are dots formed such that ink droplets landed on the print medium 101 aggregate, that is, are merged together and cured. L dots have the largest size, that is, diameter, S dots have the smallest size, and M dots have an intermediate size. Each size is defined as a defined value. Ink droplets for forming L dots, M dots, and S dots differ only in the number of drops for forming ink droplets and are emitted from one nozzle 23 in common, although the present invention is not limited to this configuration. For example, ink droplets for forming L dots, M dots, and S dots may be emitted from different nozzle rows 24. The number of nozzles 23 that eject ink droplets of each size may be determined, in accordance with the size of L dots, M dots, and S dots.

L dots reproduce a color at the highest density since their formation requires the largest ejection amount of ink, that is, the amount of ink. S dots reproduce a color at the lowest density since their formation requires the smallest ejection amount of ink. M dots reproduce a color at an intermediate density since their formation requires an intermediate ejection amount of ink.

The color-basis ejection controller 12 may control ejection of ink droplets so as to form dots of ink of the same color in the last forward scan and backward scan in the last pass for forming a surface layer in a print image.

The memory 13 is a storage device that stores variable curve data necessary for control of the first controller 11*a* and the second controller 11*b*, an ejection duty necessary for control of the first controller 11*a*, the second controller 11*b*, and the color-basis ejection controller 12, and a mask pattern necessary for control of the first controller 11*a*, the second controller 11*b*, and the color-basis ejection controller 12.

The ejection duty is data indicating the ratio of the nozzles 23 ejecting ink droplets to all of the nozzles 23 in the heads H1 to H4, in one main scan. In other words, the ejection duty is data indicating the ratio of the ejection amount to the maximum ejection amount that can be ejected in one main scan. The mask pattern is data of a pattern that determines the nozzles 23 that eject ink droplets in the heads H1 to H4 in order to specify pixels to be formed during a main scan corresponding to each pass. The variable curve data will be described in detail later.

The printing apparatus 1 operates in three modes, namely, a first mode, a second mode, and a third mode, for ejection control of ink droplets. In the first mode, ejection control of ink droplets by the first controller 11*a* is performed. In the second mode, ejection control of ink droplets by the second controller 11*b* is performed. In the third mode, ejection control of ink droplets by the color-basis ejection controller 12 is performed. These operation modes will be described in detail later.

In the configuration above, the print medium 101 is conveyed in a direction opposite to the sub scanning direction Y in order to move a print region on the print medium 101 in the sub scanning direction Y, and the carriage 2 is not moved in the sub scanning direction Y. However, in the present embodiment, any configuration may be employed as long as the carriage 2 moves relative to the print medium 101.

The printing apparatus 1 may be configured such that the print medium 101 is fixed rather than being conveyed, and the carriage 2 is moved in the sub scanning direction Y, whereby the carriage 2 is moved relative to the print medium 101. In this configuration, the driving rollers 5 or the driven rollers 6 are not necessary, but a mechanism for driving the carriage 2 in the sub scanning direction Y is necessary. An example of such a configuration is a mechanism that drives the carriage 2 together with the guide rail 3 in the sub scanning direction Y. Accordingly, the sub scan controller 9 controls the operation of this mechanism instead of control of the driving rollers 5.

In the heads H1 to H4, although the nozzle row 24 is provided on each head, a plurality of nozzle rows 24 may be provided on the same head. The heads H1 to H4 may be arranged in a staggered pattern such that the heads are alternately offset in the main scanning directions X1 and X2.

[First Mode]

Figure 4:
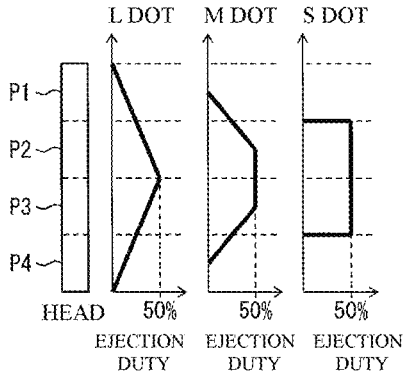
FIG. 4 is a diagram illustrating formation of L dot, M dot, and S dot in a first mode of the printing apparatus.
Figure 5:
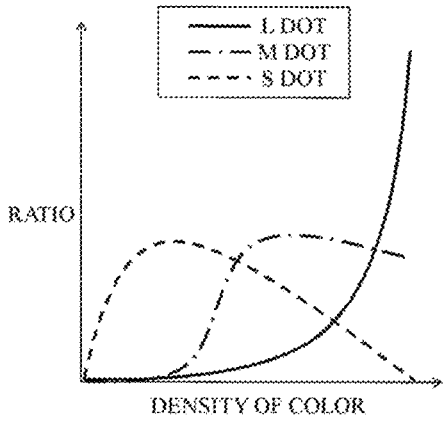
FIG. 5 is a diagram illustrating curves representing the relation between the density of color printed by the printing apparatus and the ratio of L dot, M dot, and S dot.
Figure 6A:
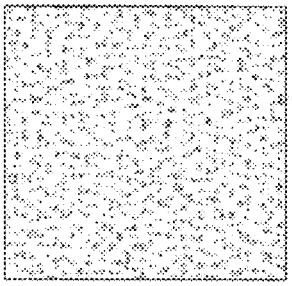
FIG. 6(*a*) is an enlarged view of an image printed by the printing apparatus, and FIG. 6(*b*) is an enlarged view of an image printed by a conventional printing apparatus.
Figure 6B:
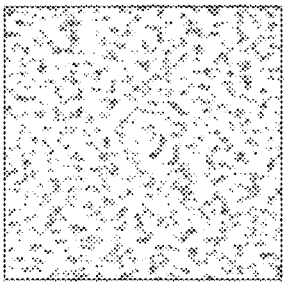

First of all, the first mode will be described. FIG. 4 is a diagram illustrating formation of L dot, M dot, and S dot in the first mode of the printing apparatus 1. FIG. 5 is a diagram illustrating variable curves representing the relation between the density of color printed by the printing apparatus 1 and the ratio of L dots, M dots, and S dots. FIG. 6(*a*) is an enlarged view of an image printed by the printing apparatus 1, and FIG. 6(*b*) is an enlarged view of an image printed by a conventional printing apparatus.

The first mode suppresses occurrence of stripes or streaks produced when the number of passes is small, and improves granularity of a print image.

The stripes or streaks visible when the number of passes is small are noticeable in a dark color portion in a print image. As previously mentioned, the density of an image formed with L dots is highest. Therefore, stripes or streaks in a print image can be made less noticeable by setting a large number of nozzles 23 that eject ink droplets of L dots and forming L dots in a large number of passes.

On the other hand, the granularity is deteriorated when ink droplets landing on the print medium 101 are displaced between passes. The deterioration of granularity is noticeable in a light color portion in a print image. Therefore, the granularity in a print image can be improved by forming S dots in a small number of passes.

The first controller 11*a* then controls the ejection timings and the ejection amounts of ink droplets forming S dots that are first ink droplets, ink droplets forming L dots that are second ink droplets, and ink droplets forming M dots that are third ink droplets, such that L dots are formed in a larger number of passes than passes for forming S dots. In the example in FIG. 4 in which printing is performed in four passes, the first controller 11*a* controls ejection of ink droplets such that L dots are formed in four passes, M dots are formed in three passes, and S dots are formed in two passes. Although it is preferable that L dots be formed using all of the defined number of passes, L dots may be formed in passes fewer than the defined number, namely, in one fewer passes, three passes, in the example illustrated in FIG. 4. On the other hand, although it is preferable that S dots be formed in the minimum number of passes, that is, in one pass, S dots may be formed in passes more than the defined number, that is, in one more passes, two passes, in the example illustrated in FIG. 4.

The "head" denoted in FIG. 4 is the heads H1 to H4 described above, and the nozzles 23 corresponding to four passes are grouped into a first pass portion P1, a second pass portion P2, a third pass portion P3, and a fourth pass portion P4. In the nozzle row 24, a first ejection region for ejecting first ink droplets, a second ejection region for ejecting second ink droplets, and a third ejection region for ejecting third ink droplets are set. The first ejection region is a region in the nozzle row 24 excluding regions in a predetermined range from both ends in the sub scanning direction Y. The first ejection region is narrowest, and the second ejection region is widest. The third ejection region is wider than the first ejection region and narrower than the second ejection region. The first to third ejection regions are set so as to vary according to the kinds of ink droplets, namely, the first to third ink droplets.

L dots, M dots, and S dots are formed as follows using the heads configured as described above.

In a first scan, the first pass portion P1 ejects ink droplets while the head moves in the forward path in the main scanning direction X1 that is the forward direction. In a second scan, the first pass portion P1 and the second pass portion P2 eject ink droplets while the head moves in the backward path in the main scanning direction X2 that is the backward direction. In a third scan, the first pass portion P1 to the third pass portion P3 eject ink droplets while the head moves in the forward path. In a fourth scan, the first pass portion P1 to the fourth pass portion P4 eject ink droplets while the head moves in the backward path. In a pass subsequent to the fourth scan, the first pass portion P1 to the fourth pass portion P4 of the head eject ink droplets. Between the scans, the print medium 101 moves in the sub scanning direction Y by a width of a band, whereby the position where the head ejects ink droplets on the print medium 101 is changed. The first controller 11*a* controls ejection of ink droplets with an ejection duty that is an ejection density as illustrated in FIG. 4, in each pass. Ink droplets are ejected in four passes divided in this way, whereby L dots, M dots, and S dots are finished.

The first controller 11*a* refers to the variable curve data stored in the memory 13 when controlling ejection of ink droplets as described above. The variable curve data represents the ratios of L dots, M dots, and S dots with respect to the density of color, as illustrated in FIG. 5, and is the characteristics representing each individual ratio of L dots, M dots, and S dots to the density by a curve that is a function. The variable curve data is prepared in the form of a table in which the density and the ratio are associated with each other.

Based on this, when acquiring the density of color from image data input to the printing apparatus 1, the first controller 11*a* obtains the ratios of L dots, M dots, and S dots corresponding to the acquired density from the variable curve data. The first controller 11*a* controls ejection/non-ejection, the ink ejection amount, and the like in each pass, based on the obtained ratios, the ejection duty of each pass, and the mask pattern.

In the example illustrated in FIG. 4, for each of the first pass portion P1, the second pass portion P2, the third pass portion P3, and the fourth pass portion P4, the upper limit of the ejection duty is set to 50%. This setting is made because the resolution of printing is higher than the spacing between adjacent nozzles 23.

As for L dots, the ejection duties of the first pass portion P1, the second pass portion P2, the third pass portion P3, and the fourth pass portion P4 are set to 12.5%, 37.5%, 37.5%, and 12.5%, respectively, which total to 100%. As for M dots, the ejection duties of the first pass portion P1, the second pass portion P2, the third pass portion P3, and the fourth pass portion P4 are set to 6.25%, 43.75%, 43.75%, and 6.25%, respectively, which total to 100%. As for S dots, the ejection duties of the first pass portion P1, the second pass portion P2, the third pass portion P3, and the fourth pass portion P4 are set to 0%, 50%, 50%, and 0%, respectively, which total to 100%.

In the example illustrated in FIG. 4, the first controller 11*a* sets the ejection duty at the center of the second ejection region to a value higher than the ejection duty at both ends in the sub scanning direction of the second ejection region. Specifically, in formation of L dots, the first controller 11*a* controls ejection of ink droplets such that the ejection duty has a slope and changes in the form of a peak, whereas in formation of S dots, the first controller 11*a* controls ejection of ink droplets such that the ejection duty is uniform at constant 50%. The reason for this is as follows. If L dots are formed based on a uniform ejection duty, the unevenness produced at the boundary between bands in a print image causes blur and is likely to cause stripes or streaks. The unevenness is therefore to be smoothed at the boundary. In formation of S dots, if the ejection duty changes with the position of the first ejection region, the landing accuracy of the first ink droplets is likely to deteriorate. The ejection duty is therefore set to be constant irrespective of the position of the first ejection region, thereby improving the landing accuracy of the first ink droplets. This can improve the granularity of a print image. In addition, a print image is formed in a few passes, so that displacement of ink droplets between passes can be suppressed.

The first controller 11*a* controls ejection of ink droplets based on the ejection duty set as described above. Specifically, the first controller 11*a* controls ejection of ink droplets such that the ejection amount increases toward the center of the head in accordance with the distance from the front end portion of the head in the first pass portion P1 and the second pass portion P2, and such that the ejection amount decreases toward the back end portion of the head in accordance with the distance from the center of the head in the third pass portion P3 and the fourth pass portion P4. The first controller 11*a* controls the ejection amount of ink droplets based on the ejection duty that changes at the boundary between passes, in formation of not only L dots but also M dots.

Furthermore, in the example illustrated in FIG. 4, S dots are formed using the second pass portion P2 and the third pass portion P3 of the head. In general, the landing positions of ink droplets ejected from a portion on the center side of the head vary less and are uniform, compared with the landing positions of ink droplets ejected from a portion on the end side of the head. It is therefore preferable to form S dots as described above in view of reducing the landing displacement.

As described above, in the first mode, L dots are formed in many passes, and S dots are formed in a few passes. Increasing the number of passes for forming L dots in this manner suppresses occurrence of stripes or streaks noticeable in dots of a dark color, that is, L dots, thereby making stripes or streaks less noticeable in the print image as a whole. As for deterioration of granularity that is likely to be noticeable in dots of a light color, that is, S dots, reducing the number of passes for forming S dots suppresses an increase of landing displacement of ink droplets, thereby improving granularity.

In an image printed in the first mode of the printing apparatus 1, as illustrated in FIG. 6(*a*), dots are distributed almost uniformly to exhibit good granularity. By contrast, in an image printed in a conventional printing apparatus, as illustrated in FIG. 6(*b*), the distribution of dots is uneven, and the granularity is impaired, because some dots overlap each other or there are many gaps between dots.

Although the number of passes is four in the example described above, the number of passes is not limited to four. In the second mode and the third mode described below, the number of passes is also not limited to the number of passes illustrated by way of example.

[Second Mode]

The second mode will now be described. The second mode suppresses occurrence of fringes resulting from reciprocating printing using UV curable ink.

The mechanism of occurrence of fringes will be described first.

Figure 7A:
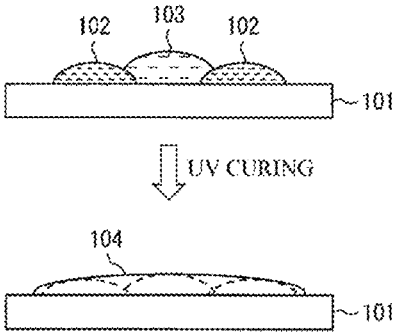
FIG. 7(*a*) is a diagram illustrating a change in which a plurality of ink droplets are merged together and cured to be flat, and FIG. 7(*b*) is a diagram illustrating a change in which an ink droplet landed between a plurality of cured ink droplets is cured.
Figure 7B:
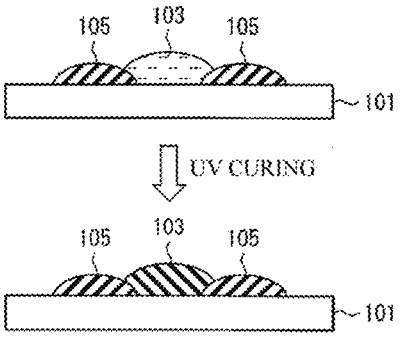
Figure 8A:
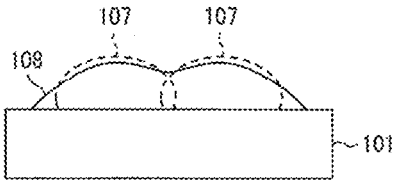
FIGS. 8(*a*) and 8(*b*) are diagrams illustrating different two states in which adjacent ink droplets on a print medium are merged and cured.
Figure 8B:
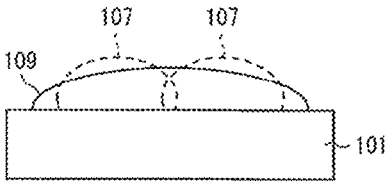
Figure 9:
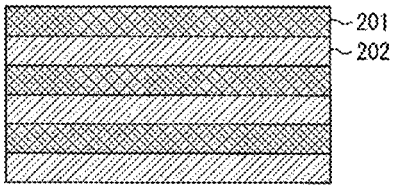
FIG. 9 is a diagram illustrating a state in which a print state differs alternately between passes as a result of reciprocating printing.

FIG. 7(*a*) is a diagram illustrating a change in which a plurality of ink droplets are merged together and cured to be flat, and FIG. 7(*b*) is a diagram illustrating a change in which an ink droplet landed between cured ink droplets is cured. FIGS. 8(*a*) and 8(*b*) illustrate two states in which adjacent ink droplets on a print medium are merged and cured. FIG. 9 is a diagram illustrating a state in which a print state differs alternately between passes as a result of reciprocating printing.

In the reciprocating printing using UV curable ink, as previously mentioned, the portion of the forward scan and the portion of the backward scan in a print image look different colors because light reflects differently depending on the angle of view. When the print image is seen from the front, stripes are not visible. However, when the print image is viewed at an angle, the portions of different colors alternately appear in the portion of the forward scan and the portion of the backward scan and thus look like stripes. This is a phenomenon in which the degree of protrusions and depressions in the surface of the print image varies and therefore looks different depending on the reflection of light.

In a gloss portion that is a glossy portion, since adjacent ink droplets spread to merge together, the dots formed of the cured ink droplets do not keep the original form of ink droplets and have less protrusions and depressions as a whole. By contrast, in a matte portion that is a matte finished portion, since ink droplets are cured before spreading, the dots keep the original form of ink droplets to some extent and have many protrusions and depressions as a whole.

Such a phenomenon occurs as the difference in state of protrusions and depressions as described above, because the time from when ink droplets are ejected to when the ink droplets landed on the print medium undergo UV radiation, that is, the time from ejection of ink droplets to curing, varies according to the distance from the head including nozzles to the UV lamp in the carriage.

As illustrated in FIG. 7(*a*), in a state in which an ink droplet 103 lands between adjacent ink droplets 102 previously landed at a distance from each other on the print medium 101, the ink droplets 102 and 103, when cured by ultraviolet rays, are merged into one to form a flat dot 104. By contrast, as illustrated in FIG. 7(*b*), in a state in which an ink droplet 103 lands between adjacent dots 105 already solidified on the print medium 101, the ink droplets 103 are not merged with the dots 105 even when cured by UV radiation, because the contact angle with the dot 105 is small and thus the ink droplet 103 is repelled by the dots 105.

When a high-density portion is to be printed, the ejection amount of ink in one scan is large. Therefore, as illustrated in FIGS. 8(*a*) and 8(*b*), when the distance between adjacent ink droplets 107 is narrow, the ink droplets 107 are easily merged together to form a new dot 108, 109. In the case illustrated in FIG. 8(*a*), since the time from landing of the ink droplets 107 to UV radiation by the UV lamp is short, a recessed portion at the merging portion of the ink droplets 107 is left in the dot 108. By contrast, in the case illustrated in FIG. 8(*b*), since the time from landing of ink droplets to UV radiation by the UV lamp is long, the ink droplets 107 are completely merged so that the dot 109 is a single block.

In general, the diameter of an UV curable ink drop significantly changes immediately after landing, and the diameter changes less after the elapse of a certain time. Therefore, when the time from landing of ink droplets to UV radiation is short, as illustrated in FIG. 8(*a*), UV radiation is performed in a state in which merging of the ink droplets 107 is in progress, so that the resulting dot 108 has protrusions and depressions including crest portions and valley portions. On the other hand, when the time from landing of ink droplets to UV radiation is long, as illustrated in FIG. 8(*b*), UV radiation is performed in a state in which the increase of the diameter of the ink droplet 107 proceeds sufficiently, so that the resulting dot 109 is cured with the ink droplets 107 completely merged together.

In general, a carriage is provided with a plurality of heads in parallel for inks of different colors or is provided with a single head having a plurality of nozzle rows ejecting different inks. A lamp is provided on each of both ends of a plurality of heads or a head having a plurality of nozzle rows. Therefore, the distance from each head or each nozzle row to the first UV lamp for use in UV radiation in the forward scan is different from the distance to the second UV lamp for use in UV radiation in the backward scan. With such a structure of the carriage, the time taken for ink droplets ejected from the nozzle row of the head to be cured by UV radiation by the first UV lamp in the forward scan is different from the time taken for ink droplets ejected from the nozzle row of the head to be cured by UV radiation by the second UV lamp in the backward scan. Thus, as illustrated in FIG. 9, in the print image, a forward scan portion 201 and a backward scan portion 202, which appear alternately, look different because of the different states of protrusions and depressions of the surface.

The time from ejection of ink droplets to UV radiation varies according to the distance from the heads H1 to H4 to the UV lamps 21 and 22 in the example illustrated in FIG. 3. The distance from the heads H1 to H4 to the UV lamp 21 for use in UV radiation in the forward scan is different from the distance to the UV lamp 22 for use in UV radiation in the backward scan. In the case of the head H1, a distance D1 to the UV lamp 21 is longer than a distance D2 to the UV lamp 22. With such a structure, the time taken for the ink droplets ejected from the heads H1 to H4 to be cured by UV radiation by the UV lamp 21 in the forward scan is different from the time taken for the ink droplets ejected from the heads H1 to H4 to be cured by UV radiation by the second UV lamp 22 in the backward scan. Thus, as illustrated in FIG. 9, in the print image, the forward scan portion 201 and the backward scan portion 202, which appear alternately, look different because of the different states of protrusions and depressions of the surface.

The second controller 11*b* will now be described.

Figure 10:
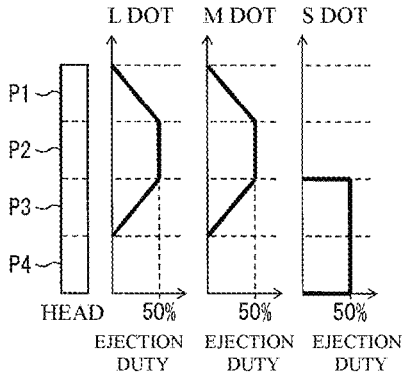
FIG. 10 is a diagram illustrating formation of L dot, M dot, and S dot in a second mode of the printing apparatus.
Figure 11A:
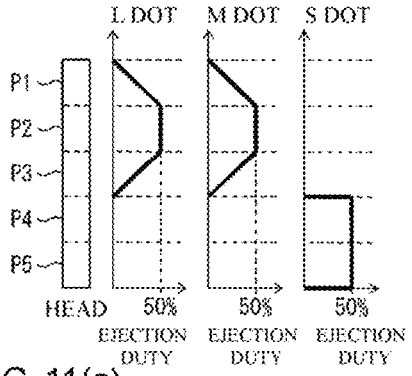
FIGS. 11(*a*) to 11(*e*) are other diagrams illustrating formation of L dot, M dot, and S dot in the second mode of the printing apparatus.
Figure 11B:
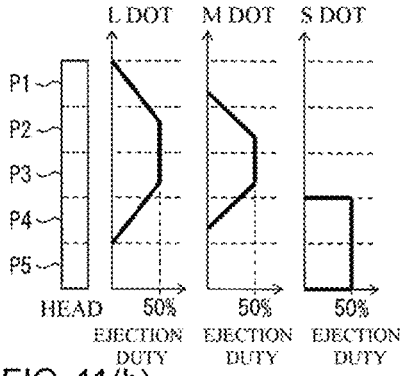
Figure 11C:
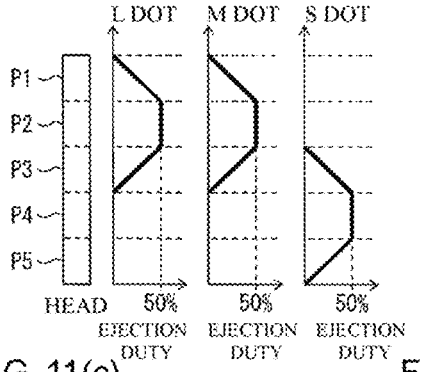
Figure 11D:
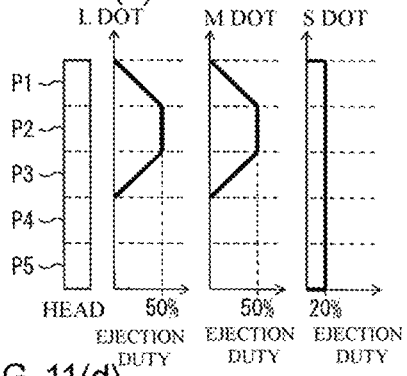
Figure 11E:
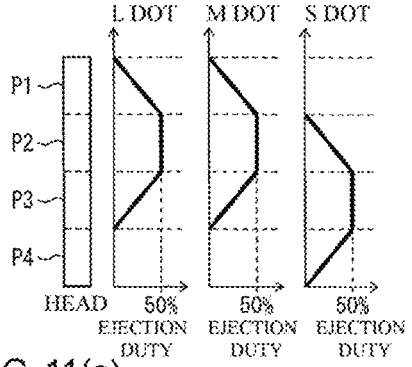
Figure 12A:
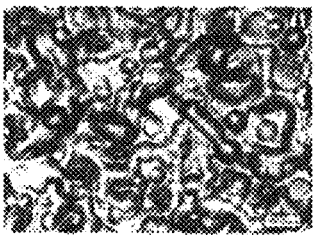
FIGS. 12(*a*) and 12(*b*) illustrate print states on a print medium in an enlarged view in which fringes are eliminated as a result of printing in the second mode, in which FIG. 12(*a*) is a microscopic image of a state of a gloss portion on the print medium and FIG. 12(*b*) is a microscopic image of a state of a matte portion on the print medium.
Figure 12B:
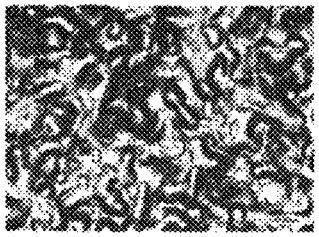
Figure 13A:
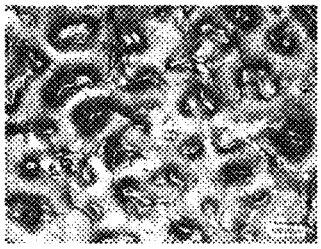
FIGS. 13(*a*) and 13(*b*) illustrate print states on a print medium in an enlarged view in a state in which fringes occur, in which FIG. 13(*a*) is a microscopic image of a state of a gloss portion on the print medium and FIG. 13(*b*) is a microscopic image of a state of a matte portion on the print medium.
Figure 13B:
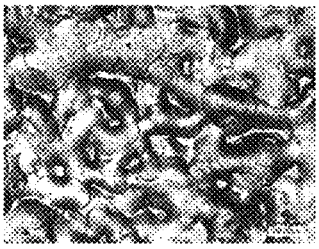

FIG. 10 is a diagram illustrating formation of L dot, M dot, and S dot in the second mode of the printing apparatus 1. FIGS. 11(*a*) to 11(*e*) are other diagrams illustrating formation of L dot, M dot, and S dot in the second mode of the printing apparatus 1. FIGS. 12(*a*) and 12(*b*) illustrate print states on a print medium in an enlarged view in which fringes are eliminated as a result of printing in the second mode of the printing apparatus 1, in which FIG. 12(*a*) is a microscopic image of a state of a gloss portion on the print medium, and FIG. 12(*b*) is a microscopic image of a state of a matte portion on the print medium. FIGS. 13(*a*) and 13(*b*) illustrate print states on a print medium in an enlarged view in which fringes occur, in which FIG. 13(*a*) is a microscopic image of a state of a gloss portion on the print medium, and FIG. 13(*b*) is a microscopic image of a state of a matte portion on the print medium.

As previously mentioned, fringes are visible because there is a difference in state of protrusions and depression in the surface between the portion of the forward scan and the portion of the backward scan in a print image. Based on this, ink droplets are ejected such that the state of protrusions and depressions is similar in the portion of the forward scan and the portion of the backward scan. For this purpose, printing is performed such that ink droplets are landed at a distance from each other. This avoids contact between dots due to merging of ink droplets and thus prevents the difference in shape, as in the dots 108 and 109 as illustrated in FIGS. 8(*a*) and 8(*b*). Accordingly, the state of protrusions and depressions in the surface can be made uniform in the portion of the forward scan and the portion of the backward scan in a print image.

However, when printing is performed such that ink droplets are landed at a distance from each other in all of the passes, the number of passes is enormous, leading to reduction of the printing speed. Then, in the second mode, after an image is almost finished by printing at a normal density such that ink droplets are merged immediately after landing, printing is performed at a low density such that ink droplets are cured at a distance from each other to form a surface layer. This can make uniform the state of protrusions and depressions of the surface in the portion of the forward scan and the portion of the backward scan in a print image, while avoiding reduction of the printing speed.

For this, the second controller 11*b* controls ejection of ink droplets such that an image is almost finished using L dots, M dots, and S dots from the initial path to a path immediately before the last pass, in a defined number of passes, both in the forward scan and in the backward scan. The second controller 11*b* also controls ejection of ink droplets such that ink droplets are landed at a distance so as not be merged together whereby S dots distributed with wide dot spacing, that is, at a low density, are formed in the surface layer of the print image, in the last pass, both in the forward scan and in the backward scan. In the example of printing in four passes in FIG. 10, the second controller 11*b* controls ejection of ink droplets such that L dots and M dots are formed in preceding three passes and S dots are formed in the third pass to form an image, and that a surface layer is formed only with S dots in at least the last pass. S dots are formed using two passes with a constant ejection duty of 50%.

The second controller 11*b* may control ejection of ink droplets such that L dots, M dots, and S dots are formed as illustrated in FIGS. 11(*a*) to 11(*e*). In any examples illustrated in FIGS. 11(*a*) to 11(*e*), the maximum ejection duty is 50%.

FIGS. 11(*a*) to 11(*d*) illustrate examples in which printing is performed in five passes. In the example illustrated in FIG. 11(*a*), L dots and M dots are formed in the first to third passes, and S dots are formed in the subsequent fourth and fifth passes.

In the example illustrated in FIG. 11(*b*), L dots and M dots are formed in the first to fourth passes, and S dots are formed in the fourth and fifth passes. Although M dots are formed over four passes, the period of substantial formation is two passes. In this example, since L dots are formed in relatively many passes, stripes or streaks produced in a high-density portion in a print image can be made less noticeable, in the same manner as in the foregoing first mode.

In the example illustrated in FIG. 11(*c*), L dots and M dots are formed in the first to third passes, and S dots are formed in the third to fifth passes.

In the example illustrated in FIG. 11(*d*), L dots and M dots are formed in the first to third passes, and S dots are formed at a uniform ejection duty of 20% in all of the passes.

In the foregoing examples illustrated in FIGS. 11(*a*) to 11(*d*), a surface layer is formed with a uniform ejection duty both in the forward scan and in the backward scan. In particular, in the example illustrated in FIG. 11(*c*), a surface layer is formed with a uniform ejection duty in the fourth pass. Forming a surface layer in this manner is preferred in terms of forming S dots uniformly in the surface layer. By contrast, in the example illustrated in FIG. 11(*e*), although S dots are formed at a uniform ejection duty of 50% in the image formation period in the third pass, S dots are formed in the surface layer while the ejection duty is changed in the fourth pass. Therefore, S dots are not distributed uniformly in the surface layer formed last, and it can be said that the example illustrated in FIG. 11(*e*) is not preferred.

The second controller 11*b* controls the ejection timing and the ejection amount of ink droplets for forming S dots, based on the ejection duty defined as illustrated in FIG. 10 and FIGS. 11(*a*) to 11(*e*). The second controller 11*b* also controls ejection of ink droplets based on the changing ejection duty, in the initial pass and the last pass for forming each of L dot, M dot, and S dot, as illustrated in FIG. 10 and FIGS. 11(*a*) to 11(*e*). Specifically, in the initial pass for forming each dot, the ejection duty linearly increases from the minimum value 0% to the maximum value 50%, and in the last pass for forming each dot, the ejection duty linearly decreases from 50% to 0%. The second controller 11*b* controls ejection of ink droplets in accordance with such changing ejection duty, in the same manner as the ejection control of ink droplets performed by the first controller 11*a*.

In order to almost finish an image in the preceding stage at least using high-density L dots and form uniform protrusions and depressions using low-density S dots in the later stage, it is preferable that the second controller 11*b* make a setting such that the nozzles 23 in a predetermined range in the heads H1 to H4 eject the largest ejection amount of ink droplets to form L dots and that the nozzles 23 eject the smallest amount of ink droplets to eject S dots. In the head illustrated in FIG. 10, the nozzles 23 in a range between the third pass portion P3 and the fourth pass portion P4, which is the subsequent scan range provided in a predetermined range from the back end portion, are set to eject the smallest ejection amount of ink droplets, and the nozzles 23 in a range from the first pass portion P1 to the third pass portion P3 excluding the fourth pass portion P4 are set to eject the largest ejection amount of ink droplets.

As described above, in the second mode, after a print image is almost finished using L dots, M dots, and S dots ejected to the surface of the print medium 101 in the main scan of a preceding pass that is a preceding scan, a surface layer of S dots at a distance from each other is formed on the almost finished print image such that the dots in the surface layer are not in contact with each other, in the main scan of at least the last pass that is a subsequent scan, to finish an image. This prevents dots from coming into contact with each other and becoming flat, and protrusions and depressions can be formed in the surface layer, irrespective of the state of protrusions and depressions formed with dots in the previous pass. Thus, the surface layer of the print image attains a uniform state of protrusions and depressions, so that there is no difference in surface state between the portion of the forward scan and the portion of the backward scan in the print image, making the fringes invisible.

If ink droplets are ejected such that dots are not in contact with each other in all of the passes, an enormous number of passes is required for printing. The number of passes thus need to be increased both in the main scanning direction and in the sub scanning direction, and this significantly reduces the printing speed. By contrast, in the second mode, at the stage in which a print image is almost finished using L dots, M dots, and S dots, ink droplets are ejected such that dots are formed at a density so that the dots are in contact with each other, thereby reducing the number of passes and suppressing reduction of the printing speed.

In the surface of the print image printed in the second mode of the printing apparatus 1, the shapes of dots are clear with few flat portions, in both the gloss portion illustrated in FIG. 12(*a*) and the matte portion illustrated in FIG. 12(*b*). By contrast, in the surface of an image printed by a conventional printing apparatus, there are many portions in which dots are continuous and flat in the gloss portion illustrated in FIG. 13(*a*), whereas in the matte portion illustrated in FIG. 13(*b*), there are fewer flat portions and many protrusions and depressions, compared with the gloss portion.

In a low-density portion in a print image, if the amount of ink droplets is large, the density of color is sparsely reduced, leading to reduction of the image quality. By contrast, the second controller 11*b* ejects ink droplets by adjusting the amount such that the amount of ink droplets ejected in the last pass is smaller than the amount of ink droplets ejected in any previous passes. Thus, whether dots are merged together can be controlled based on the amount of ink droplets. Thus, fringes can be reduced without affecting the image quality, irrespective of the level of density of color.

The second controller 11*b* also ejects ink droplets by adjusting the amount such that the amount of ink droplets ejected in at least one pass that is an intermediate pass is smaller than the amount of ink droplets ejected in the other passes, of the passes for almost finishing a print image before the pass for forming a surface layer that is a pass for finishing the print image. Accordingly, in the passes for almost finishing a print image, variable dots with different sizes can be formed. This can increase the number of gray levels of the print image and improve the image quality.

In addition, the second controller 11*b* may control ejection of ink droplets such that adjacent dots in the intermediate layer formed in the main scan of an intermediate pass that is the intermediate scan are not in contact with each other. Accordingly, dots are uniformly formed at a distance from each other in a stage preceding the pass for forming the surface layer, so that fringes can be effectively suppressed. On the other hand, as in the examples illustrated in FIGS. 11(*a*) to 11(*d*), the surface layer may be formed by controlling ejection of ink droplets based on a constant ejection duty, so that S dots formed in the surface layer have uniform diameters, thereby effectively suppressing fringes. Therefore, these ejection controls are performed in combination to further increase the effect of suppressing fringes.

In the second mode, S dots are formed in the surface layer of a print image in the examples described above. However, any dots except for L dots may be formed in the surface layer, and M dots may be formed.

[Third Mode]

Figure 14A:
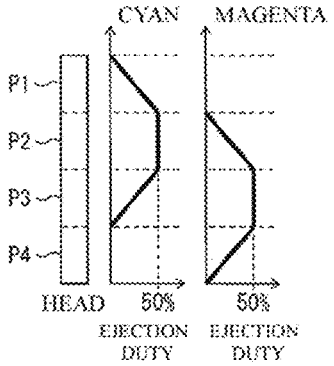
FIGS. 14(*a*) and 14(*b*) are diagrams illustrating formation of dots corresponding to ink colors in a third mode of the printing apparatus.
Figure 14B:
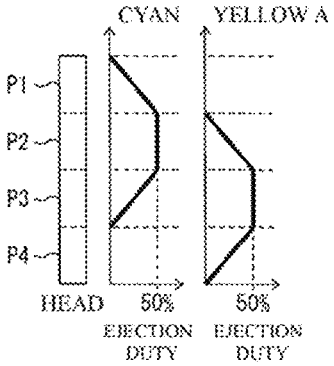
Figure 15:
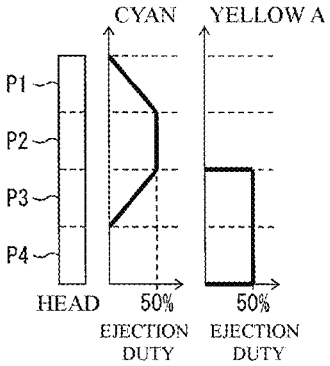
FIG. 15 is another diagram illustrating formation of dots corresponding to ink colors by the printing apparatus.

Finally, the third mode will be described. FIGS. 14(*a*) and 14(*b*) are diagrams illustrating formation of dots corresponding to ink colors in the third mode of the printing apparatus 1. FIG. 15 is another diagram illustrating formation of dots corresponding to ink colors in the printing apparatus 1.

The third mode suppresses color unevenness resulting from the difference in order of ink overlapping in reciprocating printing.

In reciprocating printing, the order in which the heads H1 to H4 of different colors arranged in the main scanning directions X1 and X2 eject ink droplets is switched between the forward scan and the backward scan, so that the order of colors in which ink droplets overlap on the print medium 101 is also switched. Therefore, in the print image, the color in the portion of the forward scan look different from the color in the portion of the backward scan. In such a situation, the color of the surface is easily affected.

In order to avoid the inconvenience described above, there exists a head having nozzles arranged such that the ejection orders of ink in the forward scan and in the backward scan are the same. The inconvenience described above can also be avoided by shifting the heads ejecting inks of different colors and performing printing simultaneously so as to reduce the number of passes. However, such a configuration complicates the configuration of the heads.

Then, in the third mode, ejection of inks is controlled such that the ink forming the surface layer of a print image in the forward scan and the ink forming the surface layer of a print image in the backward scan are of the same color, thereby suppressing color unevenness between the portion of the forward scan and the portion of the backward scan in the print image.

For this, the color-basis ejection controller 12 controls ejection of inks such that ink of the color specified in the last pass is ejected both in the forward scan and in the backward scan. In the example illustrated in FIG. 14(*a*) in which printing is performed in four passes, the color-basis ejection controller 12 controls the ejection order of ink droplets such that cyan ink droplets are ejected in the first pass to the third pass, and magenta ink droplets are ejected in the second pass to the fourth pass. In the example illustrated in FIG. 14(*b*) in which printing is performed in four passes similarly, the color-basis ejection controller 12 controls ejection of ink droplets such that cyan ink droplets are ejected in the first pass to the third pass, and yellow ink droplets are ejected in the second pass to the fourth pass.

The color-basis ejection controller 12 controls ejection of ink droplets based on the mask pattern stored in the memory 13, such that ink droplets are ejected in such an ejection order of ink droplets.

The color-basis ejection controller 12 also controls ejection of ink droplets based on the changing ejection duty, in the initial pass and the last pass for ejecting ink droplets of each color. Specifically, the ejection duty increases linearly from the minimum value 0% to the maximum value 50% in the initial pass for ejecting ink droplets of each color, and the ejection duty decreases linearly from 50% to 0% in the last pass for ejecting ink droplets of each color. The color-basis ejection controller 12 controls ejection of ink droplets in accordance with such changing ejection duty, in the same manner as the ejection control of ink droplets performed by the first controller 11*a*.

The ejection control of ink droplets by the color-basis ejection controller 12 described above is specifically performed as follows.

In the example illustrated in FIG. 14(*a*), first of all, in the first pass, when the carriage 2 moves in the main scanning direction X1, cyan ink droplets are ejected from the head H1. In the subsequent second pass, when the carriage 2 moves in the main scanning direction X2, cyan ink droplets are ejected from the head H1, and magenta ink droplets are ejected from the head H2. In the subsequent third pass, when the carriage 2 moves in the main scanning direction X1, cyan ink droplets are ejected from the head H1, and magenta ink droplets are ejected from the head H2. Then, in the last fourth pass, when the carriage 2 moves in the main scanning direction X2, magenta ink droplets are ejected from the head H2. Printing of one band called "first band" here is thus completed.

In printing of the following band called "second band" here, in the first pass, the carriage 2 moves in the main scanning direction X2 which is the same as in the scan in the second pass in printing of the first band and which is the opposite direction to the direction in the scan in the first pass in printing of the first band. In this way, the scan of the same pass is performed in the opposite main scanning directions X in adjacent bands.

In the first band, since the carriage 2 moves in the main scanning direction X1 in the third pass, as illustrated in FIG. 3, cyan ink droplets ejected from the head H1 are landed on the print medium 101 and cured by ultraviolet rays from the UV lamp 22, and magenta ink droplets ejected from the head H2 are landed on the cyan ink and cured. On the other hand, in the second band, since the carriage 2 moves in the main scanning direction X2 in the third pass, magenta ink droplets ejected from the head H2 are landed on the print medium 101 and cured by ultraviolet rays from the UV lamp 21, and cyan ink droplets ejected from the head H1 are landed on the magenta ink and cured. In this way, in the third pass, magenta dots are formed on cyan dots in the first band, and cyan dots are formed on magenta dots in the second band, so that the surface state differs between those bands.

However, in both bands, since magenta ink droplets are ejected in the last fourth pass, magenta dots are always formed on each surface layer. This reduces the color difference between the surface layers of the bands in the print image and therefore can eliminate color stripes.

In the example illustrated in FIG. 14(*b*), the ink droplet ejection order for magenta in the example illustrated in FIG. 14(*a*) is merely replaced by the ink droplet ejection order for yellow, and yellow dots are always formed on the surface layer of the bands in the print image. Therefore, the surface state of each band in the print image is uniform, and color stripes can be eliminated, as in the example illustrated in FIG. 14(*a*). Since yellow has the characteristic of making stripes less noticeable, it is preferable to form yellow dots in the surface layer in terms of further suppressing occurrence of stripes.

In the example illustrated in FIG. 14(*b*), contrast (difference in density) is produced due to the difference in ejection duty in the second and third passes. Then, in the example illustrated in FIG. 15, the color-basis ejection controller 12 controls ejection of ink droplets such that cyan ink droplets are ejected in the first to third passes in the same manner as in the example illustrated in FIG. 14(*b*) and yellow ink droplets are ejected based on a uniform ejection duty of 50% in the third and fourth passes. This can eliminate the density difference. In the case of yellow ink, since stripes are less noticeable, occurrence of stripes can be suppressed without changing the ejection duty.

As described above, in the third mode, a surface layer is formed by ejecting a certain ink, preferably, ink of one or more colors in the scan in the last pass. Accordingly, the surface layer is of the same color in the portion of the forward scan and the portion of the backward scan in the print image, so that color unevenness can be suppressed without using a head of a special configuration.

Although the ejection order for two kinds of inks has been described in the foregoing example, for convenience of explanation, inks of other colors are ejected as appropriate in the passes other than the last pass. Although cyan ink droplets are ejected in the first pass in the examples illustrated in FIG. 14(*a*), FIG. 14(*b*) and FIG. 15, magenta illustrated in FIG. 14(*a*) or yellow illustrated in FIG. 14(*b*) and in FIG. 15 may be ejected together.

[Implementation by Software]

The control block of the printing apparatus 1, specifically, the ejection controller 10 may be implemented by a logic circuit that is hardware formed on an integrated circuit as an IC chip or may be implemented by software using a central processing unit (CPU).

In the latter case, the printing apparatus 1 includes a CPU that executes instructions of a program that is software implementing the functions, a read only memory (ROM) or a storage device, referred to as a "recording medium", encoded with the program and various data in a computer- or CPU-readable form, and a random access memory (RAM) that expands the program. The computer or CPU reads and executes the program from the recording medium to achieve the object of the present invention. Examples of the recording medium include a "non-transitory tangible medium", such as tape, disk, card, semiconductor memory, and programmable logic circuit. The program may be supplied to the computer through any transmission media, such as communication network or broadcast waves that can transmit the program. The present invention may be implemented in the form of data signals embedded in carrier waves in which the program is embodied by electronic transmission.

[Supplementary Remarks]

In a printing method of the printing apparatus 1, a scan of applying light after ink droplets of photocurable ink land on a print medium 101 and curing the ink droplets to form dots is performed on a predetermined unit region alternately in a forward direction and a backward direction. The time from landing of the ink droplets onto the print medium to curing differs between the forward direction and the backward direction. In a subsequent scan to form a surface layer of the unit region in the scan performed multiple times, ejection of the ink droplets is controlled such that the dots are formed at a density so that the dots in the surface layer are not in contact with each other.

The printing apparatus 1 includes: heads H1 to H4 each having a plurality of nozzles 23 for ejecting ink droplets of photocurable ink to a print medium 101, the nozzles 23 being arranged in a sub scanning direction Y orthogonal to main scanning directions X1 and X2 to form a nozzle row 24; a main scan controller 8 and a sub scan controller 9 configured to move the heads H1 to H4 in the main scanning direction so as to perform a scan in the main scanning direction on a predetermined unit region back and forth multiple times and to move the heads H1 to H4 relative to the print medium 101 in the sub scanning direction Y for each scan in the main scanning directions X1 and X2; light sources configured to apply light to the ink droplets so as to form dots by curing the ink droplets ejected to the print medium 101, the light sources being disposed on both sides in the main scanning directions X1 and X2 of the heads H1 to H4; and an ejection controller 10 configured to control ejection of the ink droplets such that, in a subsequent scan to form a surface layer of the unit region in the scan performed multiple times, the dots are formed at a density so that the dots in the surface layer are not in contact with each other.

In the configuration described above, the dots are not in contact with each other in the subsequent scan to finish an image, thereby preventing dots from coming into contact each other to be flat. Irrespective of the state of protrusions and depressions of dots formed in the previous main scan, protrusions and depressions can be formed in the surface layer. Thus, the surface layer of the print image attains a uniform state of protrusions and depressions, so that the surface state is indistinguishable between the portion of the forward scan and the portion of the backward scan in the print image, fringes can be made to be invisible.

In the printing method, it is preferable that, in at least part of the dots formed in the subsequent scan, ejection of the ink droplets be controlled such that the amount of the ink droplets ejected to form one of the dots is smaller than the amount of the ink droplets ejected to form one of the dots formed in a preceding scan that is a scan performed before the subsequent scan.

In the configuration described above, whether the dots are in contact with each other can be controlled by adjusting the amount of ink droplets. Thus, fringes can be reduced without affecting the image quality, irrespective of the level of density of color.

In the printing method, it is preferable that, for at least part of the dots formed in the preceding scan in the scan performed multiple times, ejection of the ink droplets be controlled such that the amount of the ink droplets ejected to form one of the dots is equal to the amount of the ink droplets ejected to form one of the dots formed in the subsequent scan.

In the configuration described above, the dots in the preceding scan include dots formed with an amount equal to the ejection amount of ink droplets in the subsequent scan and dots formed with an amount larger than the ejection amount of ink droplets in the subsequent scan. Thus, variable dots having different sizes can be formed also in the preceding scan serving to suppress fringes in the surface of the print image and to form an image. The image quality thus can be improved.

In the printing method, it is preferable that, in the subsequent scan, ejection of the ink droplets be controlled based on a constant ejection duty.

In the configuration described above, the ejection duty is kept constant in the subsequent scan, so that dots are formed uniformly over the entire surface layer by the subsequent scan for finishing an image. Thus, fringes can be suppressed effectively without causing unevenness in the scan region.

In the printing method, it is preferable that, in an intermediate scan performed before the subsequent scan, ejection of the ink droplets be controlled such that the dots are formed at a density so that the dots in an intermediate layer formed in the intermediate scan are not in contact with each other, and ejection of the ink droplets be controlled based on a constant ejection duty.

In the configuration described above, even when the ejection duty is not constant in the subsequent scan, dots are formed uniformly in a scan region in the preceding stage, so that fringes can be suppressed more effectively. When the ejection duty is kept constant in the subsequent scan, unevenness can be suppressed in the scan region more effectively, thereby suppressing fringes effectively.

In the printing method, it is preferable that, in a preceding scan performed before the subsequent scan in the scan performed multiple times, ejection of the ink droplets be controlled such that the dots are formed at a density so that at least part of the dots ejected to a surface of the print medium are merged together.

When a high-density image is formed, if ink droplets are ejected such that the dots are not in contact with each other in all of the multiple scans, an enormous number of scans is required for printing. The number of scans thus need to be increased, and the printing speed is significantly reduced. By contrast, in the configuration described above, in a high-density image, at least part of dots are in contact with each other in a preceding scan. This enables formation of an image with a smaller number of scans. Thus, reduction of the printing speed can be suppressed.

In the printing apparatus 1, it is preferable that the ejection controller 10 make a setting such that a smallest ejection amount of ink droplets is ejected by the nozzles 23 in a predetermined range forward of an end portion on the back side of the heads H1 to H4 when the heads H1 to H4 move relative to the print medium 101 in the sub scanning direction Y, and the range includes a subsequent scan range to eject ink droplets in the subsequent scan, and a range on the front side of the heads H1 to H4 relative to the subsequent scan range be allocated.

Thus, dots having different sizes can be formed in the front and the back in the relative movement direction of the heads H1 to H4. Accordingly, dots of desired sizes can be formed in the order of scans formed by the multi-pass.

The present invention is not limited to the foregoing embodiments and is susceptible to various modifications within the range shown by the claims, and embodiments obtained by combining technical means disclosed in different embodiments as appropriate are also embraced in the technical range of the present invention.

INDUSTRIAL APPLICABILITY

The present invention can be suitably used in an inkjet printer performing printing by the multi-pass method.

What is claimed is:

1. A printing method, wherein after ink droplets of a photocurable ink are landed on a print medium, a scan of applying a light to cure the ink droplets to form dots is performed alternately in a forward direction and a backward direction with respect to an unit region which is predetermined, and a time from landing to curing of the ink droplets onto the print medium differs between the forward direction and the backward direction, and the printing method comprising:

providing the ink droplets that include: a large dot having a large amount of ink per droplet, and a small dot having a smaller amount of ink per droplet than that of the large dot; and controlling ejection of the ink droplets, such that number of passes when forming the large dot is greater than number of passes when forming the small dot, when forming a print image.

2. The printing method according to claim 1, wherein in the scan performed multiple times, ejection of the ink droplets is controlled such that a subsequent scan of forming a surface layer of the unit region is performed by using the small dot, and a preceding scan that is a scan performed before the subsequent scan is performed by using the large dot.

3. The printing method according to claim 2, wherein for at least part of the dots formed in the preceding scan in the scan performed multiple times, ejection of the ink droplets is controlled such that an amount of the ink droplets ejected to form one of the dots is equal to an amount of the ink droplets ejected to form one of the dots formed in the subsequent scan.

4. The printing method according to claim 3, wherein in an intermediate scan performed before the subsequent scan, ejection of the ink droplets is controlled such that the dots are formed at a density so that the dots in an intermediate layer formed by the intermediate scan are not in contact with each other, and ejection of the ink droplets is controlled based on a constant ejection duty.

5. The printing method according to claim 2, wherein in the subsequent scan, ejection of the ink droplets is controlled based on a constant ejection duty.

6. The printing method according to claim 1, wherein in a preceding scan performed before the subsequent scan in the scan performed multiple times, ejection of the ink droplets is controlled such that the dots are formed at a density so that at least part of the dots ejected to a surface of the print medium are merged together.

7. A printing apparatus, comprising:

a head, including a plurality of nozzles for ejecting ink droplets of a photocurable ink to a print medium, the nozzles being arranged in a sub scanning direction orthogonal to a main scanning direction to form a nozzle row;

a movement controller, configured to move the head in the main scanning direction, so as to perform a scan in the main scanning direction back and forth multiple times on an unit region which is predetermined and to move the head relative to the print medium in the sub scanning direction for each scan in the main scanning direction;

light sources, configured to apply a light to the ink droplets to cure the ink droplets ejected to the print medium to form dots, the light sources being disposed on both sides in the main scanning direction of the head; and an ejection controller, configured to control ejection of the ink droplets such that, the ink droplets include: a large dot having a large amount of ink per droplet, and a small dot having a smaller amount of ink per droplet than that of the large dot, and in the scan performed multiple times, a subsequent scan of forming a surface layer of the unit region is performed by ejecting the small dot on a constant ejection duty.

8. The printing apparatus according to claim 7, wherein the ejection controller makes a setting such that: a smallest ejection amount of the ink droplets is ejected by the nozzles in a range which is predetermined forward of an end portion on a back side of the head when the head moves relative to the print medium in the sub scanning direction, and the range includes a subsequent scan range to eject the ink droplets in the subsequent scan, and the ejection controller makes a setting such that: a largest ejection amount of the ink droplets is ejected by the nozzles in a range on a front side of the head relative to the subsequent scan range.

* * * * *